US007641195B2

(12) United States Patent
Suzuki

(10) Patent No.: US 7,641,195 B2
(45) Date of Patent: Jan. 5, 2010

(54) SHEET CONVEYING APPARATUS AND IMAGE FORMING APPARATUS

(75) Inventor: Toshimasa Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 11/844,638

(22) Filed: Aug. 24, 2007

(65) Prior Publication Data

US 2008/0061498 A1 Mar. 13, 2008

(30) Foreign Application Priority Data

Sep. 7, 2006 (JP) ..... 2006-243471

(51) Int. Cl.
*B65H 29/54* (2006.01)

(52) U.S. Cl. ..... 271/307; 271/312; 271/204; 271/224

(58) Field of Classification Search ..... 271/307, 271/312, 204, 206, 224
See application file for complete search history.

(56) References Cited

U.S. PATENT DOCUMENTS 3,116,924 A * 1/1964 Huck ..... 271/182
5,431,386 A * 7/1995 Blaser ..... 271/204
5,671,920 A * 9/1997 Acquaviva et al. ..... 271/307
6,056,287 A * 5/2000 Hirth et al. ..... 271/204
6,648,326 B2 * 11/2003 Hieb ..... 271/183
6,991,229 B2 * 1/2006 Yamakawa et al. ..... 271/223
7,165,764 B2 1/2007 Nakamura et al. ..... 270/58.11
7,487,968 B2 * 2/2009 Landwehr ..... 271/312
2005/0179190 A1 8/2005 Kamiya et al. ..... 270/58.07

FOREIGN PATENT DOCUMENTS

JP 61-174058 8/1986
JP 2006-124051 5/2006

* cited by examiner

*Primary Examiner*—David H Bollinger
(74) *Attorney, Agent, or Firm*—Fitzpatrick, Cella, Harper & Scinto

(57) ABSTRACT

The sheet conveying apparatus includes a first member configured to convey a sheet along a predetermined conveying path while holding the sheet, a second member configured to convey a sheet along the predetermined conveying path while holding the sheet, and a changing unit configured to change a first state in which the first member and the second member convey the same sheet along the predetermined conveying path and a second state in which the first member and the second member convey different sheets in the predetermined conveying path according to a length of a sheet along the predetermined conveying path.

5 Claims, 9 Drawing Sheets

SHEET CONVEYING APPARATUS AND IMAGE FORMING APPARATUS

BACKGROUND OF THE INVENTION

1. Field of the Invention

The present invention relates to a sheet conveying apparatus for conveying sheets and to an image forming apparatus.

2. Description of the Related Art

Conventionally, an apparatus body of an image forming apparatus selected from the group consisting of a photocopier, a printer and the like for forming an image onto a sheet occasionally conveys a sheet where an image is formed with an apparatus body and includes a sheet stacking apparatus (stacker) for stacking a large amount of the conveyed sheets. Such a stacker is described in Japanese Patent Application Laid-Open No. 2006-124051. A stacker 100 in FIG. 8 is described in Japanese Patent Application Laid-Open No. 2006-124051.

A sheet discharged from the apparatus body of an image forming apparatus is conveyed to an inlet roller pair 101 and is guided upward by a flapper 102. A sheet is further guided upward and is discharged into a sample tray 109 above a stacker. Even if the sheet is guided upward, in the case where the sheet is conveyed in a normal state, the sheet passes a conveying path 103 to be conveyed further from outlet roller pair 104 to a post processing apparatus (not illustrated in the drawing) in the downstream. In addition, in the case where the sheet is guided to a downward path by the flapper 102, the sheet is discharged and stacked on a stacking tray 106 by a discharging roller 105. The stacking tray 106 moves up and down with an elevating apparatus not illustrated in the drawing and is adjusted in height so that the height on the upper plane of the stacking sheet is always kept constant with a sheet plane detecting lever 110.

However, in that stacker, the stacking tray 106 is horizontal. Therefore, in the case of a sheet such as an easily bending thin sheet, the sheet is discharged from the outlet roller pair 104 so that the tip of the sheet droops and rubs against already stacked sheets to occasionally result in jamming.

Therefore, the stacker 100 illustrated in FIG. 8 conveys the tip of the sheet discharged from a discharging roller 105 being gripped by grippers 107*a* and 107*b* on a belt 108. The tip of the sheet is urged to the stopper 114 and the sheet is disengaged from the grippers 107*a* and 107*b*. Thereby, the sheet drops onto the stacking tray 106 and is stacked. The belt 108 is hung by a drive pulley 111 and a driven pulley 112 to circulate in the direction of an arrow A. The grippers 107*a* and 107*b* are provided with a common interval on the belt 108.

However, in the stacker 100 adapted as described above, if grippers are arranged so as to be capable of conveying and stacking sheets with half sheet sizes A4, B5 and the like at an occasion of conveying a sheet with large sheet sizes A3, B4 and the like, there are present grippers 107*a* and 107*b* which do not grip the sheet. The grippers which do not grip a sheet will hamper conveyance of a sheet to occasionally damage an image while an image is formed on the sheet.

Therefore, in a sheet conveying apparatus in conventional stacker, grippers are arranged in an interval to allow a sheet of the maximum length to be stacked to be conveyed. However, when the grippers are thus arranged, the distance for conveying a sheet gets long to make sheet conveying efficiency worse when a short sheet in length in the sheet conveying direction is conveyed. In that case, when a short sheet in length in the sheet conveying direction is conveyed, acceleration of the circulation velocity of the belt is conceivable.

However, a change in the circulation velocity of the belt based on sheet length gives rise to another problem that structure and controls get complicated.

In addition, in an apparatus disclosed in Japanese Patent Application Laid-Open No. S61-174058, a pair of drive shafts provided at a predetermined spaces and four sprockets 913 being present in each of those drive shafts are axially arranged in a position so as to face each other as illustrated in FIG. 9A and FIG. 9B. The four sprockets 913 are divided into two outer sprockets 913 arranged in both ends of the drive shaft and two units are arranged inside the outer sprockets 913. Four roller chains 914 are respectively attached to those sprockets 913 in mesh with each other and rotate corresponding with rotation of respective sprockets 913. The roller chains 914 consist of two chains put on the inner sprockets 913 respectively and other two chains put on the outer sprockets 913 respectively. The two chains arranged inside and two chains arranged outside come into communication with a plurality of tie bars 915 and 916 mounted on chains 914 respectively to form pair structure. The distance between two roller chains 914 brought into communication with the tie bars 915 and 916 substantially corresponds with the width of a sheet (length in the direction perpendicular to the conveying direction) in the sheet size A3. Each sprocket 913 on the side of the respective drive shaft is axially connected to those two sets of roller chains 914 through a clutch 917 and can, therefore, rotate independently. Relative positions of a plurality of tie bars 915 fixed on the roller chains 914 and a diaper 916 is freely variable in the direction of movements of the roller chains 914. Tie bars 915 and 916 are provided on the outer surface thereof with a gripper 918 capable of gripping the tip of the sheet.

In the case where that apparatus conveys a sheet 919 with a sheet size A3, as illustrated in FIG. 9A, two sets of roller chains 914 are provided so that they are changed in their relative positions by the clutch 917 to move the gripers 918 of both chains so as to come substantially closer to each other. The tip of the sheet 919 with a sheet size A3 is gripped by grippers 918 (grippers provided in the outer roller chain in FIG. 9A) located on the delayed side in the sheet moving direction and is conveyed. At that occasion, the grippers of the inner roller chain do not hold a sheet and enter a rotary or non-rotary state in cooperation with outside roller chain.

In the case of conveying a sheet 920 with the sheet size A4, the relative positions of the two sets of roller chains 914 are changed as illustrated in FIG. 9B. That is, the positions of the tie bars 915 and 916 are moved so that the tie bars 915 of the inner roller chain 914 come in substantially center position of two tie bars 916 and 916 provided in the outer roller chain 914. The distance between the mutually adjacent tie bars 915 and 916 is set to the length of the sheet with the sheet size A4. Thus, once the relative positions of the two sets of roller chains 914 are set subjected to displacement in the longitudinal direction of the roller chain, then both of the roller chains 914 and 914 start rotating in cooperation with each other to convey the sheet 920 with the gripper 918 of both of the roller chains 914 and 914.

In the case of conveying a sheet 920 with the sheet size A4, the relative positions of the two sets of the roller chains 914 are changed as illustrated in FIG. 9B. That is, the positional relation of the tie bars 915 and 916 is adjusted so that the tie bar 915 of the inner roller chain 914 is arranged in the substantially center position of the two tie bars 916 provided in the outer roller chain 914. The distance between the mutually adjacent tie bars 915 and 916 is set to the sheet length of a sheet with the sheet size A4. Thus, when the relative positions of the two sets of roller chains 914 are set, then both of the roller chains 914 start rotating in cooperation with each other to convey the sheet 920 with the grippers 918 of both of roller chains 914.

In an apparatus disclosed in that Japanese Patent Application Laid-Open No. S61-174058, a gripper holding no sheet at an occasion of conveying a sheet with a sheet size A3 is located in the position in the vicinity of the gripper 918 which conveys the sheet. That is, at an occasion of conveying a sheet with the sheet size A3, the gripper 918 conveying the sheet and the gripper conveying no sheet will be in an aligned state in the sheet conveying direction. Here, in order to prevent the grippers holding no sheet refrains from contacting the sheet to be conveyed to damage the sheet, the space for the grippers holding no sheet has to be secured in the direction of conveying the sheet. Accordingly, the distance among a plurality of grippers gripping a sheet has to be lengthened for the space secured for the grippers regaining no sheet. Accordingly, it is necessary to lengthen the distance between the grippers for conveying the sheet and, therefore, sheet conveyance efficiency is not good.

SUMMARY OF THE INVENTION

A purpose of the present invention is to provide a highly efficient apparatus in conveying a sheet.

Another purpose of the present invention it to provide a highly processing-efficient apparatus.

A further purpose of present invention is to provide a sheet conveying apparatus including a first member configured to convey a sheet along a predetermined conveying path while holding the sheet, a second member configured to convey a sheet along the predetermined conveying path while holding the sheet and a changing unit configured to change a first state in which the first member and the second member convey the same sheet along the predetermined conveying path and a second state in which the first member and the second member convey different sheets in the predetermined conveying path according to a length of a sheet along the predetermined conveying path.

A further purpose of present invention is to provide a sheet conveying apparatus including a first member configured to convey a sheet along a predetermined conveying path while holding the sheet a second member configured to convey a sheet along the predetermined conveying path while holding the sheet and a changing unit configured to change a first state in which the first member conveys a sheet along the predetermined conveying path and the second member is retracted from the predetermined conveying path and a second state in which the second member conveys a sheet along the predetermined conveying path according to a length of a sheet along the predetermined conveying path.

A still further purpose of the present invention will become apparent from the following description of exemplary embodiments with reference to the attached drawings.

DESCRIPTION OF THE EMBODIMENTS

A sheet stacking apparatus of embodiments of the present invention and an image forming apparatus including that sheet stacking apparatus will be described below based on the drawings.

(Image Forming Apparatus)

Figure 1:
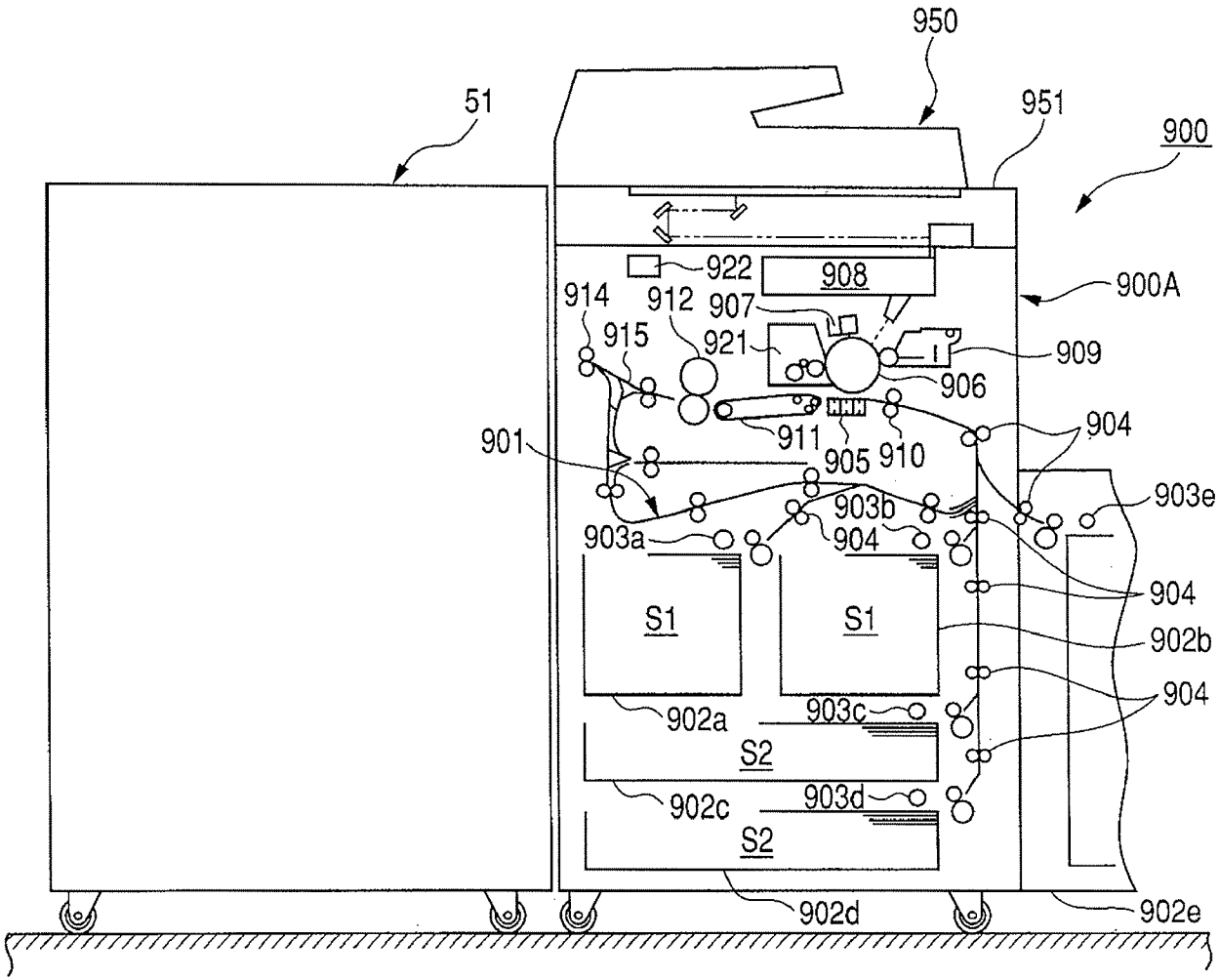
FIG. 1 is a section of an image forming apparatus of an embodiment of the present invention along a sheet conveying direction.

FIG. 1 is a section of an image forming apparatus of an embodiment of the present invention along a sheet conveying direction. An image forming apparatus 900 includes an apparatus body 900A provided with a sheet stacking apparatus 51 (hereinafter to be referred to as "stacker"). The stacker 51 is optionally connected to the apparatus body 900A but can be incorporated inside the apparatus body 900A. A controller 922 controls operations of the image forming apparatus 900.

The apparatus body 900A includes an image reader 951 and an original paper auto-feeding apparatus 950 in the upper portion. A sheet set in a sheet feeding cassettes 902*a* to 902*e* is conveyed to reach resist roller pair 910 with sheet feeding rollers 903*a* to 903*e* and conveying roller pair 904. Here, in the sheet feeding cassettes 902*a* and 902*b*, sheets S1 with the half sheet size are stored and sheets S2 with the large sheet size are stored in sheet feeding cassettes 902*c* and 902*d*.

On the other hand, a photosensitive drum 906 as an image forming unit is exposed to light by an exposure portion 908 in the state charged by a primary charger 907 to form digital original data of an original read with an image reader 951 as an electrostatic latent image. A developing device 909 develops the photosensitive drum 906 with toner to make a toner image from the electrostatic latent image.

Positioning with the toner image, a sheet is delivered by the registration roller pair 910 to the space between the photosensitive drum 906 and the transferring device 905. The transferring device 905 transfers a toner image from the photosensitive drum 906 onto the sheet. Foreign matter such as residual toner attached to the photosensitive drum 906 without having been transferred onto the sheet is scratched off with the blade of a cleaning apparatus 921. Consequently, the photosensitive drum 906 is cleaned to get ready for next image forming.

The sheet on which a toner image has been transferred is conveyed to a fixing device 912 by a conveying belt 911 and is sandwiched by a heat roller and a pressure roller of the fixing device 912 to get heated and pressed so that a toner image is fixed. The sheet on which a toner image has been fixed is directly conveyed to the stacker 51 by the sheet discharging roller pair 914 and otherwise conveyed to a duplex device 901 by the flapper 915 so that a toner image is formed again on the plane of the opposite side.

The image forming apparatus 900 includes an operating portion 920*a* operated by a user for various kinds of setting on the image forming apparatus 900. A controller 920 controls the image forming apparatus based on inputs to the operating portion 920*a*.

(Stacker)

Next, a stacker will be described. Like reference characters designate the same or similar parts throughout the figures thereof to appropriately omit duplicated description.

Figure 2A:
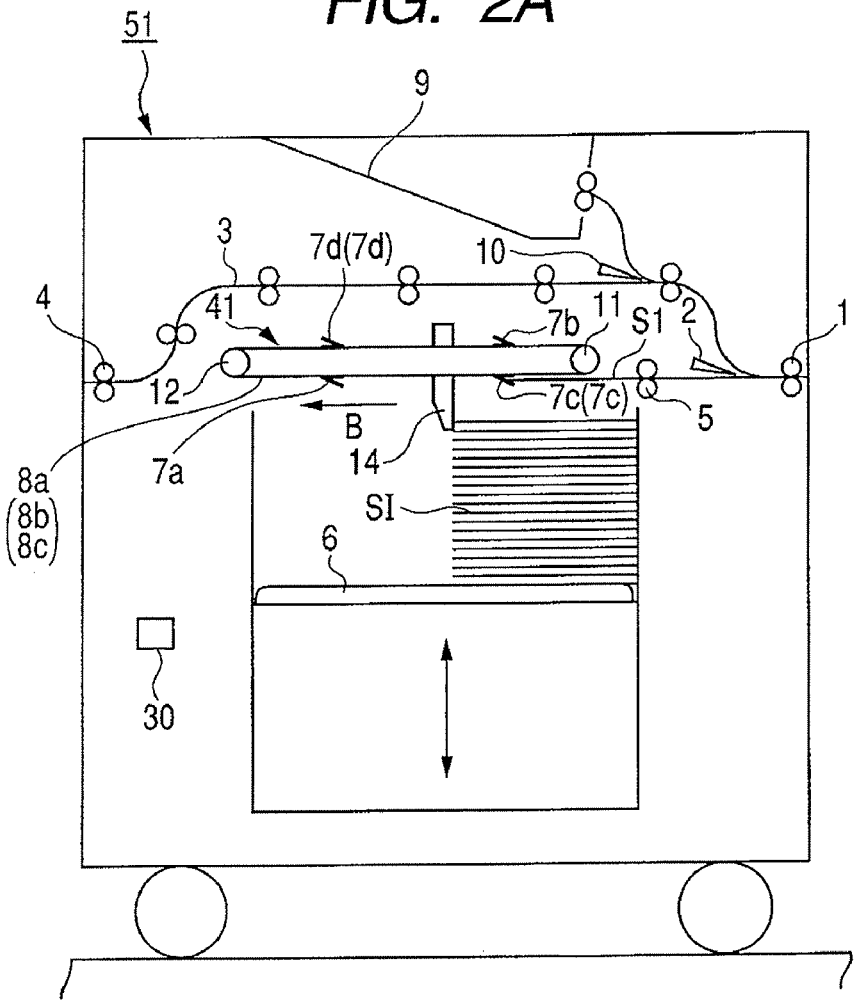
FIG. 2A is a section along the sheet conveying direction of a sheet stacking apparatus in the state where sheets with the half sheet size are stacked.
Figure 2B:
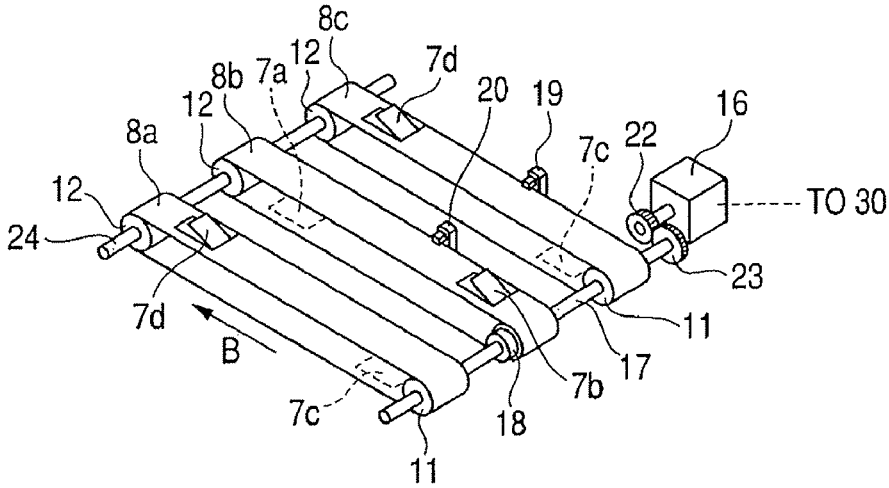
FIG. 2B is a perspective view of belts of the sheet stacking apparatus in the case of stacking sheets with the half sheet size.

FIG. 2A and FIG. 2B illustrate the case of stacking sheets with the half sheet sizes A4 and B5 and the like (hereinafter to be referred to as "half sheet"). FIG. 2A is a schematic section along the sheet conveying direction of a sheet stacking apparatus in the midst of stacking half sheets. FIG. 2B is a perspective view of belts of the sheet stacking apparatus in the case of conveying the half sheet.

Figure 3A:
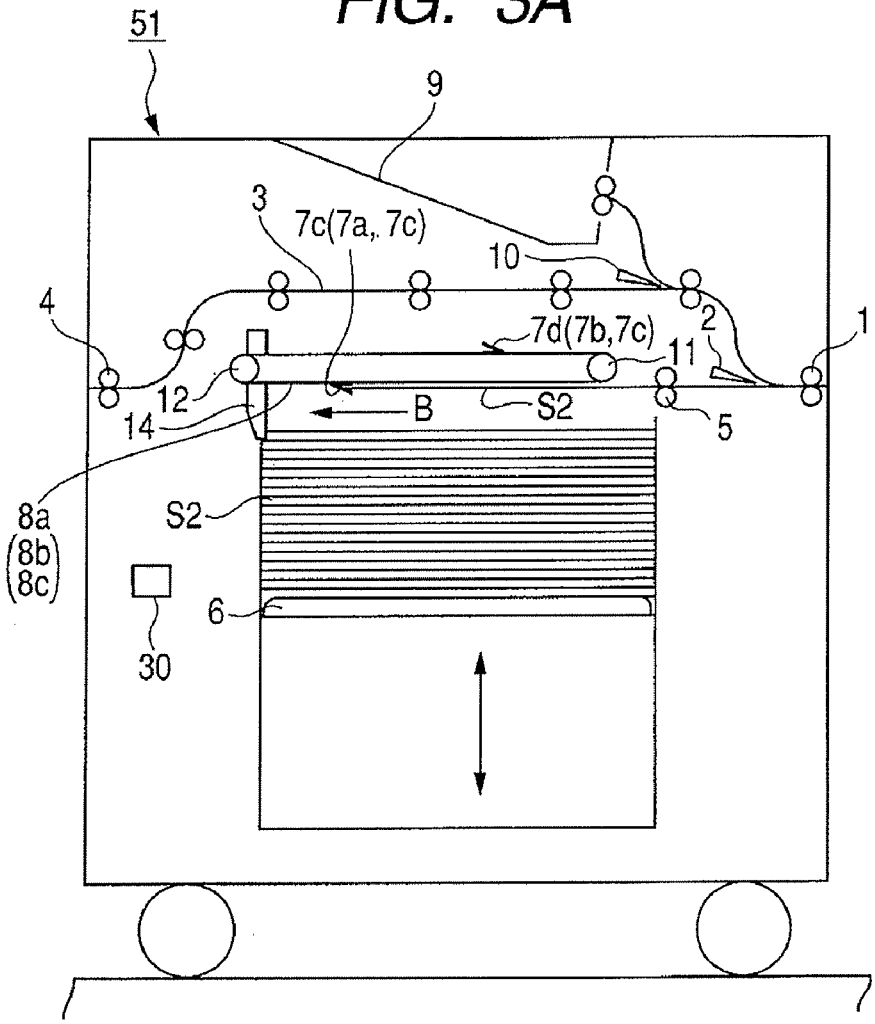
FIG. 3A is a section of a sheet stacking apparatus along the sheet conveying direction in a state of stacking sheets with a large sheet size.
Figure 3B:
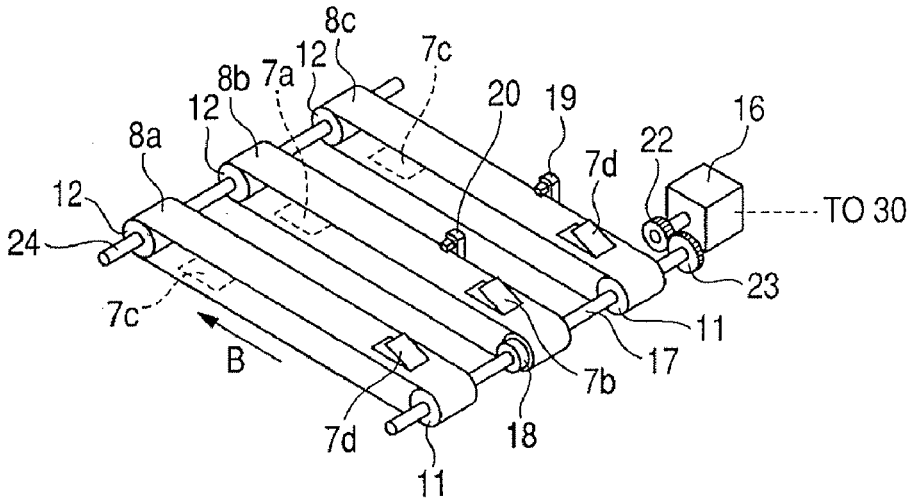
FIG. 3B is a perspective view of belts of the sheet stacking apparatus in the case of stacking sheets with a large sheet size.

FIG. 3A and FIG. 3B are diagrams at stacking sheets with the large sheet sizes A3, B4 and the like (hereinafter to be referred to as "large sheet". FIG. 3A is a schematic section along the sheet conveying direction of a sheet stacking apparatus in the midst of stacking large sheets. FIG. 3B is a perspective view of belts of the sheet stacking apparatus.

(Schematic Description on Stack Apparatus Operation)

In the case where a user provides an inputs to designate a sample tray 9 into an operating portion 920*a*, the tips of the flappers 2 and 10 rotate downward. A sheet is conveyed from the apparatus body 900A to an inlet roller pair 1 of the image forming apparatus 900 (FIG. 1). The sheet is guided by the flappers 2 and 10, conveyed to the sample tray 9 and discharged.

In addition, in the case where a user designates post processing apparatus not illustrated in the drawing connected to the downstream with an input to the operating portion 920*a*, the flapper 2 rotates downward and the flapper 10 rotates upward. Then, the sheet is guided to the conveyance path 3 and sent from an outlet roller pair 4 into the post processing apparatus not illustrated in the drawing.

Moreover, in the case where a user designates a stacker tray 6 as a stacking unit with an input to the operating portion 920*a*, the sheet is guided to a sheet discharging roller pair 5 by the flapper 2 and the tip thereof is gripped by one of all and any of grippers 7*a* to 7*d* of a first belt 8*a* to a third belt 8*c* as a circulating body. The sheet is gripped by the grippers and conveyed onto a stacker 6. When the tip of the sheet gripped by the grippers is brought into contact with a tip stopper 14, the sheet falls off the grippers and drops on the stacker tray 6. Accordingly, the position of the tip stopper 14 comes to a releasing position for releasing the grippers from holding sheets.

Here, the operation of the stacker 51 is controlled by a controller 30, which exchanges information with a controller 920 which controls the image forming apparatus 900 in its entirety. Here, one of both of the controllers 920 and 30 can be incorporated in the other.

(Description on Stack Apparatus Structure)

In FIG. 2B and FIG. 3B, a first belt 8*a* and a third belt 8*c* as first rotary bodies on both sides are hung over a drive pulley 11 fixed on a drive shaft 17 and a driven pulley 12 provided on a driven shaft 24 in a freely rotary manner. The first belt 8*a* and the third belt 8*c* circulate in the direction of an arrow B in receipt of rotary driving power by gears 22 and 23 from a drive motor 16. The respective grippers 7*c* and 7*d* as a first member provided in the first belt 8*a* and the third belt 8*c* are provided at an equal space in the circulating direction (sheet conveying direction) of the belt so as to circulate in a synchronized manner. A third belt 8*c* is provided on its sides with a detection sensor 19 for detecting positions of the grippers 7*c* and 7*d*.

The drive shaft 17 is provided with a clutch pulley 18 capable of switching ON/OFF of drive linkage of the drive motor 16.

A second belt 8*b* in the center as a second rotary body is hung over the clutch pulley 18 and a driven pulley 12 provided on a driven shaft 24 in a freely rotary manner. Therefore, the second belt 8*b* is activated by the clutch pulley 18 to circulate and stop. Here, the first belt 8*a* and the third belt 8*c* can be respectively driven and controlled by separate motors.

The second belt 8*b* is provided with the grippers 7*a* and 7*b* as second member at an equal space in the circulating direction of the belt. The second belt 8*b* is also provided on its sides with a detection sensor 20 for detecting positions of the grippers 7*a* and 7*b*.

A sheet conveying apparatus 41 is adapted to include the first belt 8*a*, the third belt 8*c*, the second belt 8*b* and the rippers 7*a* to 7*d* provided in the respective belts.

The tip stopper 14 is movable corresponding with the size (length) of sheets stacked on the stacker tray 6.

The respective grippers 7*a* to 7*d* as a holding portion are adapted to include a pair of opening and closing piece provided with a spring property. The tip of the sheet is pushed into the opening and closing piece thereof. In addition, each gripper can be provided with an elastic member such as sponge inside the respective V-shaped members so that the tip of a sheet is pushed in between the elastic members thereof. Thus, being capable of gripping a sheet, the gripper damages the sheet little since the sheet rapidly falls off when the sheet comes into contact to the tip stopper 14.

In addition, instead of a gripper, as holding portion, there can be an apparatus suctioning the sheet with air and static electricity. Also in such a case, the gripper damages the sheet little since the sheet rapidly falls off when the sheet comes into contact to the tip stopper 14.

The controller 30 of the stacker 51 obtains information on the sheet type through the controller 920 of the image forming apparatus 900 based on an input from the operating portion 920*a*. Information on sheet type is selected from the group consisting of sheet sizes, sheet orientations, sheet material, information on sheet discharge destinations and the like. The sheet orientation refers to which of the longer line or the shorter line is headed for the sheet conveying direction. Accordingly, the sheet length information is obtainable based on the sheet size information and the sheet orientation information. Here, the sheet length information can be input by a user directly and otherwise by outside information apparatus such as a personal computer. Moreover, the sheet conveying route can be provided with a sensor to obtain the information based on operations of the sensor.

(Description on Stacking Apparatus)

From the controller 920 of the apparatus body 900A, the controller 30 of the stacker 51 obtains information that the sheet is a half sheet. Here, the controller 30 moves, to the position of the half sheet, the position of the tip stopper 14 as a matching member for determining the position of the sheet tip.

The first belt 8*a* and the third belt 8*c* rotates at the same velocity as the discharge velocity of the sheet discharged from the sheet discharging roller pair 5 in the direction of the arrow B.

The first half sheet S1 discharged from the discharging roller pair 5 is gripped by each gripper 7*c* on the first belt 8*a* and the third belt 8*c* circulated by the drive motor 16 and is conveyed onto the stacker tray 16. The half sheet S1 contacts the tip stopper 14, is released from the gripper 7*c*, drops onto the tray 6 and is stacked.

The rotary position of the second belt 8*b* is positioned in advance by the detection sensor 20 and the clutch pulley 18.

Each belt at the time of the half sheet conveyance is positioned so that the distance between the gripper 7*a* and the gripper 7*c* in the circulating direction, the distance between the gripper 7*c* and the gripper 7*b* in the circulating direction, the distance between the gripper 7*b* and the gripper 7*d* in the circulating direction and the distance between the gripper 7*d* and the gripper 7*a* in the circulating direction come into all equal relation. In addition, the respective grippers 7*c* and 7*d* on the first belt 8*a* and the third belt 8*c* are aligned in the direction perpendicular to the belt circulating direction so as to be capable of concurrently gripping the half sheet tip.

The second half sheet is gripped at its tip by the gripper 7*b* on the second belt 8*b* almost without any interval after the first half sheet, conveyed onto the stacker tray 6 and is discharged. At that occasion, the signal of the detection sensor 20 of the second belt 8*b* is used for controlling the position in order to bring the gripper 7*b* and the half sheet tip into matching.

Moreover, the third half sheet is gripped by respective grippers 7*d* on the first belt 8*a* and the third belt 8*c*, conveyed onto the stacker tray 6 and is discharged.

Thus, in the present stacker 51, the distance in the conveying direction between the respective grippers of the first to third belts 8*a*, 8*b* and 8*c* is positioned so as to match the half sheet size. Therefore, sheets can be stacked on the stacker tray 6 with the conveying interval between the half sheets being kept constant and shorter than in the conventional cases. The stacker tray 6 freely moves up and down and descends corresponding with the sheet stacking amount subjected to detection of the upper plane of the sheet by a sensor not illustrated in the drawing so that the upper plane of the sheet gets to the constant height.

Accordingly, the present stacker 51 can improve the stacking efficiency of the sheet with the half sheet size than the conventional one. Here, in the case where the circulation velocity of the first to third belts 8*a*, 8*b* and 8*c* gets uneven, the stacker 51 can be adjusted to make the circulation velocity constant.

In FIG. 3A, the controller 30 of the stacker 51 obtains, from the controller 920 of the apparatus body 900A, information that the sheet is a large sheet. Here, the controller 30 causes the position of the tip stopper 14 of the stacker 51 to move from the half sheet position to the direction of the arrow B to stand by in the large sheet position.

Thereafter, the controller 30 drives the drive motor 16 to activate the clutch pulley 18 in the state where the first to third belts are circulated and to displace the position of the second belt 8*b* from the first belt 8*a* and the third belt 8*c* by length equivalent to the semiperimeter of the belts. Then the grippers 7*b* and 7*a* on the second belt 8*b* and the grippers 7*d* and 7*c* on the first belt 8*a* and the third belt 8*c* come to the state of being aligned in the direction perpendicular to the belt circulating direction.

In that state, the large sheet S2 conveyed firstly is gripped concurrently by the three grippers 7*d*, 7*b* and 7*d* on the first to third belts and conveyed onto the stacker tray 6. The large sheet S2 contacts the tip stopper 14, is released from the gripper 7*c*, drops onto the tray 6 and is stacked.

The second sheet is gripped concurrently by the three grippers 7*c*, 7*a* and 7*c* on the first to the third belts, conveyed onto the stacker tray 6 and stacked. The third large sheet is conveyed onto the stacker tray 6 by the three grippers 7*d*, 7*b* and 7*d* likewise the first large sheet and stacked.

A large sheet is long in length in the sheet conveying direction (discharging direction). Therefore, a conventional stacker buckles to occur jamming. However, the present stacker will occur little jamming since the sheet is pulled and conveyed by the grippers. Moreover, the large sheet is gripped and conveyed by three grippers and therefore is conveyed and stacked in the more certain manner to occur little jamming.

Here, the case of the half sheet was exemplified by a mode where the relative positions of the grippers 7*a* and 7*b* to the grippers 7*c* and 7*d* in the belt circulating direction is moved to the positions corresponding with the length of the half sheet so as to cope with two types of sheets of the large sheet and the half sheet respectively. However, the present invention is not limited to cope with the two types. That is, more belts are provided separately so as to cope with sheets of three or more types. And in the constitution, at an occasion of conveying sheets with shorter length, the relative positions of the grippers on the separately provided belt to the grippers 7*c* and 7*d* in the belt circulating direction is set to the position corresponding with the length of the sheet. Such a constitution is acceptable.

Figure 4A:
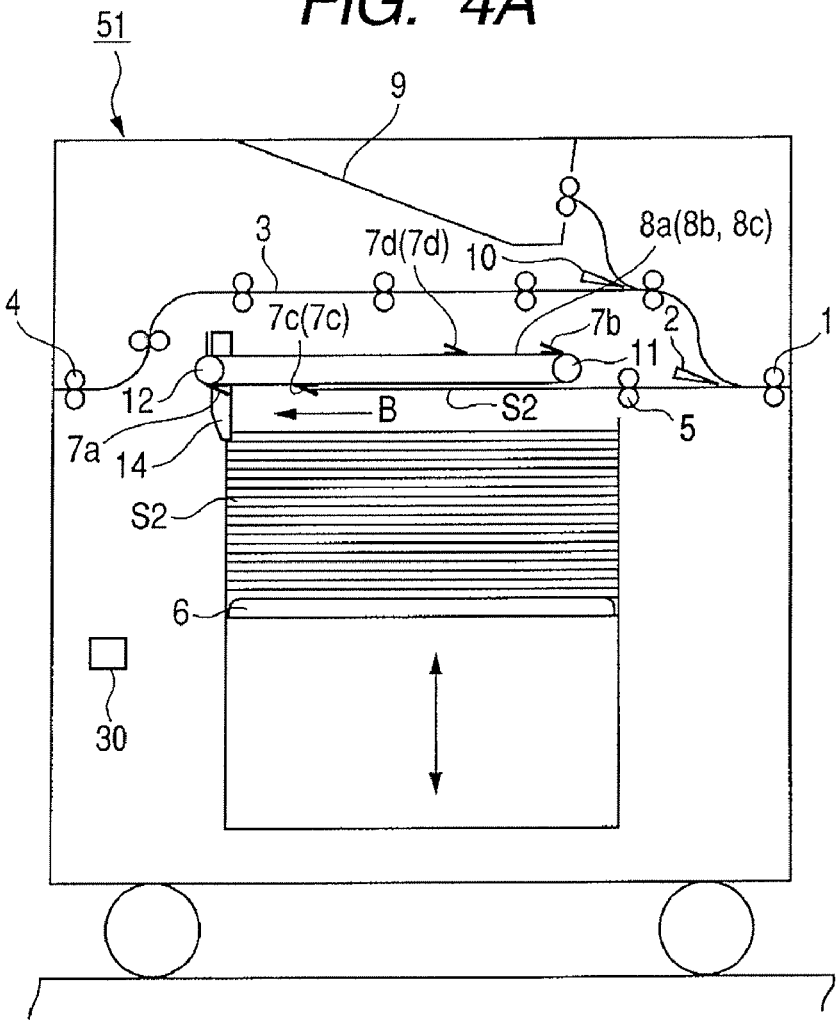
FIG. 4A is a section along the sheet conveying direction of a sheet stacking apparatus related to an embodiment variation.
Figure 4B:
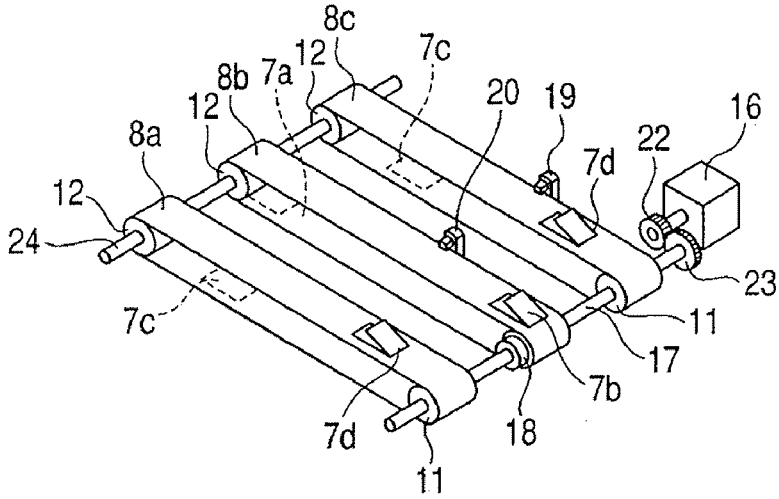
FIG. 4B is a perspective view of belts of a sheet stacking apparatus.

That is, in the case of a large sheet, the present stacker 51 can convey the large sheet only with the first belt 8*a* and the third belt 8*c* on both sides as illustrated in FIG. 4A and FIG. 4B. In that case, the controller 30 controls the clutch pulley 18 to cause the grippers 7*a* and 7*b* of the second belt 8*b* in the center to withdraw to retracted positions so as not to hamper large sheet conveyance of the first belt 8*a* and the third belt 8*c* so that the rotary power of the drive motor 16 is not transmitted to the second belt 8*b*. At that occasion, the retracted positions of the grippers 7*a* and 7*b* of the second belt 8*b* in the center are positions outside the conveyance region of the sheet gripped by the grippers 7*c* and 7*d* provided to the first belt 8*a* and the third belt 8*c* on both sides.

Here, the apparatus can be constituted so that it can cope with three or more types of sheet. That is, further additional belts and grippers on the belts are provided. At the occasion of conveying a shorter sheet, the positions of the grippers to the grippers 7*c* and 7*d* are set to the position in the belt circulating direction corresponding with length of the sheet. At an occasion of conveying a long sheet, those grippers are positioned in the retracted positions in advance.

Figure 5A:
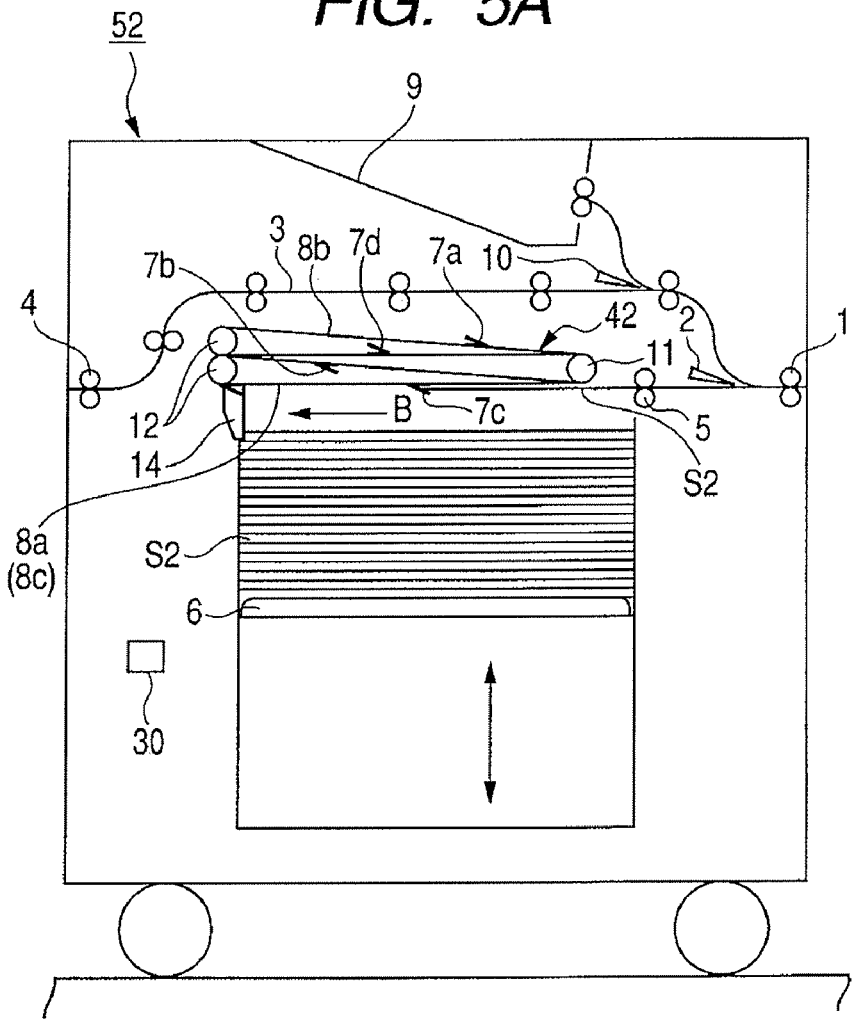
FIG. 5A is a state diagram in the case where a sheet with the large sheet size is conveyed in a sheet stacking apparatus different from FIGS. 2A and 2B.
Figure 5B:
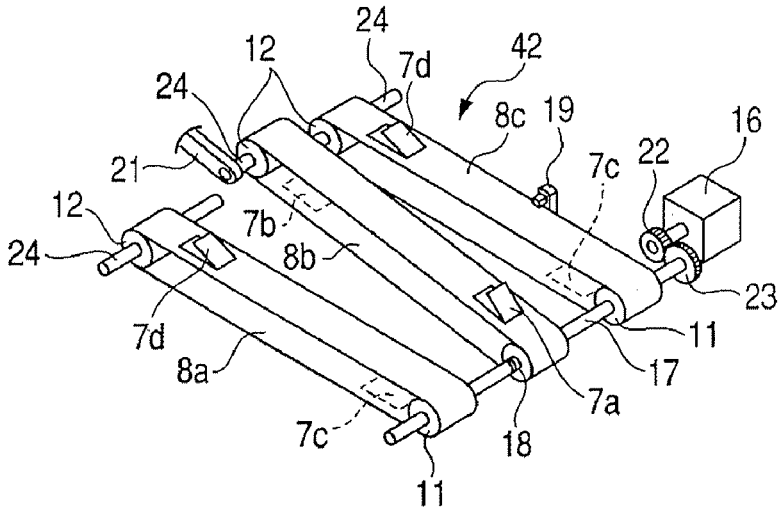
FIG. 5B is a perspective view of the belts.

Here, in order to convey a large sheet only with the first belt 8*a* and the third belt 8*c* on both sides, a lever 21 withdraw the second belt 8*b* in the center upward as in the stacker 52 illustrated in FIG. 5. Rotation of the second belt 8*b* is caused to stop in the state where the grippers 7*a* and 7*b* are positioned in the retracted positions so as not to hamper large sheet conveyance. Thereby, the large sheet can be conveyed only by the first belt 8*a* and the third belt 8*c*. That is, the second belt 8*b* is moved to withdraw the grippers 7*a* and 7*b* provided in the second belt 8*b* from the conveyance region of the sheet conveyed by the grippers 7*c* and 7*d*.

Here, the driven shafts 24 supporting the driven pulleys 12 of the three belts are separated respectively. In addition, in the case of stacking half sheets with that stacker 52, the second belt 8*b* in the center is caused to descend to convey and stack the half sheet onto the stacker tray 6 in the state likewise FIG. 2.

The sheet conveying apparatus 42 is adapted to include the first belt 8*a*, the third belt 8*c*, the second belt 8*b* capable of going up and down and the grippers 7*a* to 7*d* provided in the respective belts.

Here, the first belt 8*a* and the third belt 8*c* can be caused to stop to convey the sheet with the second belt 8*b* in the center.

Thus, in the case where a plurality of belts is present to convey one sheet and large sheets are stacked, the belt to cause to circulate is made less abundant in number to enable decrease of drive load and the working sound.

The constitution can cope with three or more types. That is, further additional belts and grippers on the belts are provided. At the occasion of conveying a shorter sheet, the positions of those separately provided grippers to the grippers 7*c* and 7*d*are set to the position in the circulating direction corresponding with length of the sheet. At an occasion of conveying a long sheet, the belts are moved so that those grippers are positioned in the retracted positions.

(Stacker of Another Embodiment)

The stacker 53 illustrated in FIG. 6A, FIG. 6B, FIG. 7A and FIG. 7B can be designed to be capable of conveying a half sheet only with the second belt 8*d* in the center and conveying both of a half sheet and a large sheet with the first belt 8*a* and the third belt 8*d* on both sides. Length of the second belt 8*d* in the center as a second circulating member is a half of length of the first belt 8*a* and the third belt 8*d* on both sides.

The sheet conveying apparatus 43 is adapted to include the first belt 8*a*, the third belt 8*c*, the second belt 8*b* and the grippers 7*a* to 7*d* provided in the respective belts.

Figure 6A:
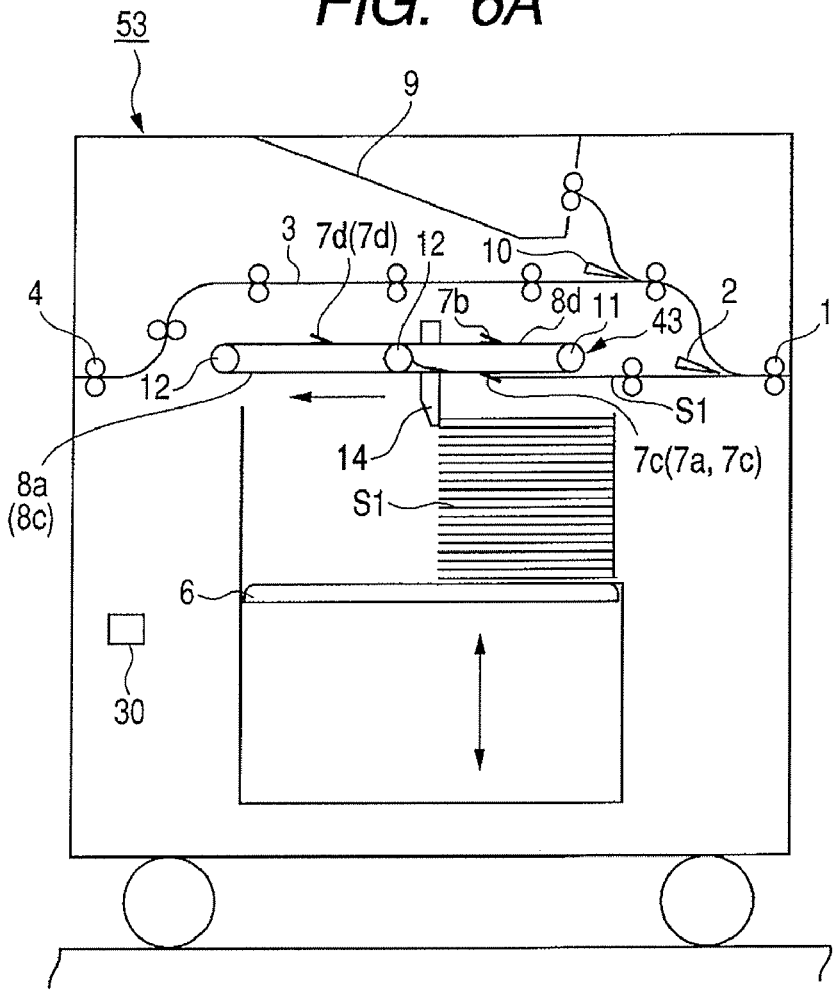
FIG. 6A is a section of a sheet stacking apparatus different from FIGS. 2A and 2B in the case of conveying sheets with the half sheet size.
Figure 6B:
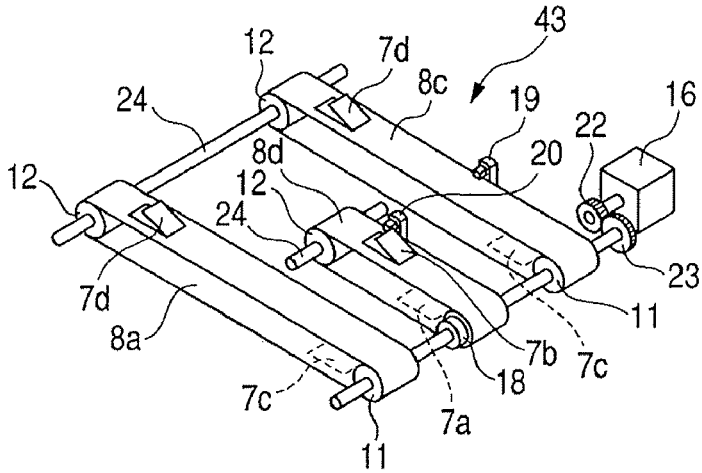
FIG. 6B is a perspective view of belts.

FIG. 6A and FIG. 6B are diagrams in the case where half sheets are stacked. The grippers 7*a* on the second belt 8*d* is adjusted in position by a clutch pulley 18 in the direction perpendicular to the gripper 7*c* of the other belts 8*a* and 8*c* in the circulating direction (correspondent in the orthogonal direction).

The first half sheet S1 is gripped by three grippers 7*c*, 7*a* and 7*c* and conveyed. The second half sheet is gripped by the gripper 7*b* on the second belt in the center and conveyed. The third half sheet is gripped by three grippers 7*d*, 7*a* and 7*d* and conveyed. The fourth half sheet is gripped by the gripper 7*b* on the second belt in the center and conveyed. Thereafter likewise operations are repeated so that the half sheets are conveyed and stacked.

Figure 7A:
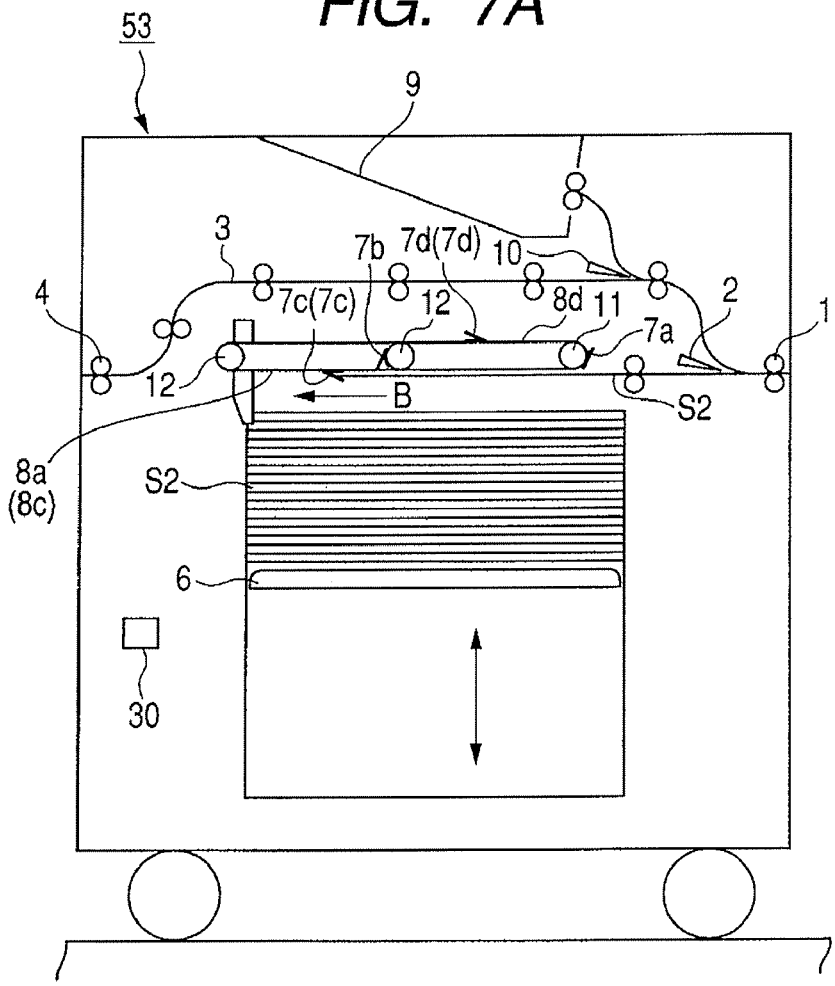
FIG. 7A is a section of the sheet stacking apparatus illustrated in FIG. 6A in the case of conveying sheets with the large sheet size.
Figure 7B:
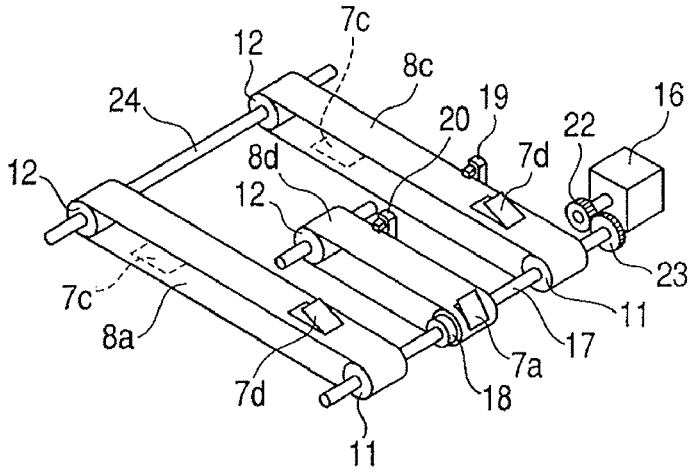
FIG. 7B is a perspective view of belts.
Figure 8:
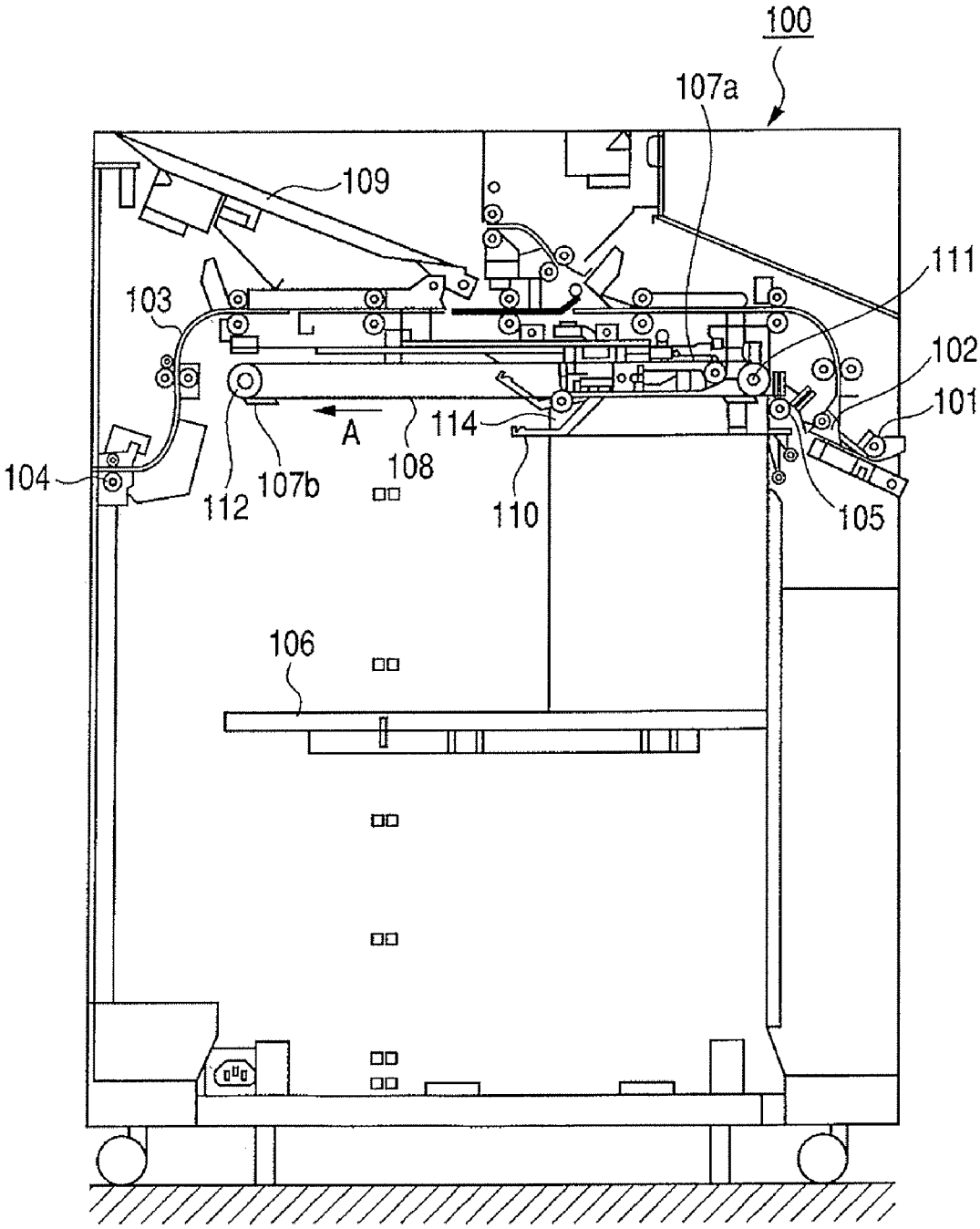
FIG. 8 is a section of a conventional sheet stacking apparatus along a sheet conveying direction.
Figure 9A:
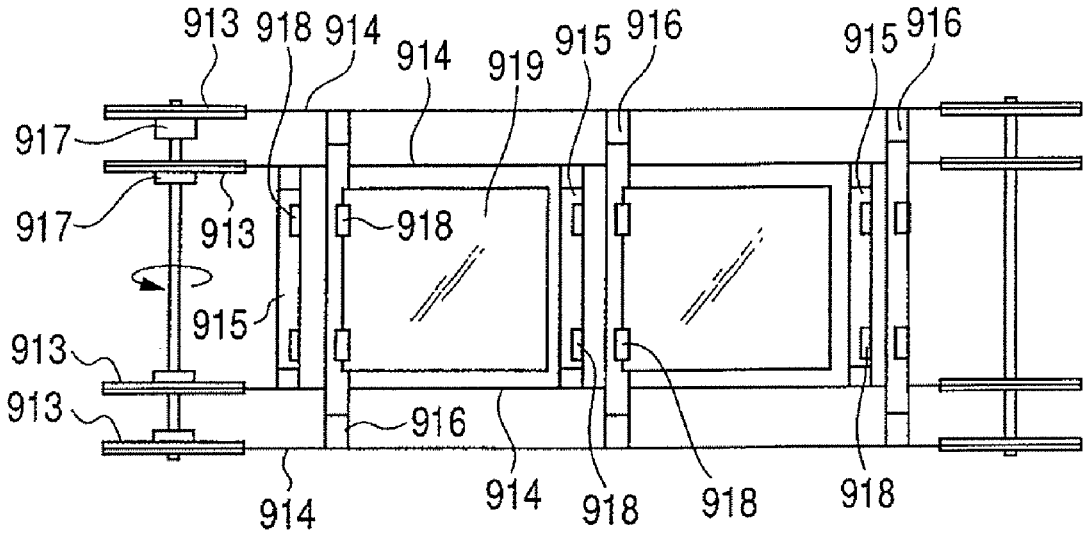
FIGS. 9A and 9B are top views of a conventional apparatus.
Figure 9B:
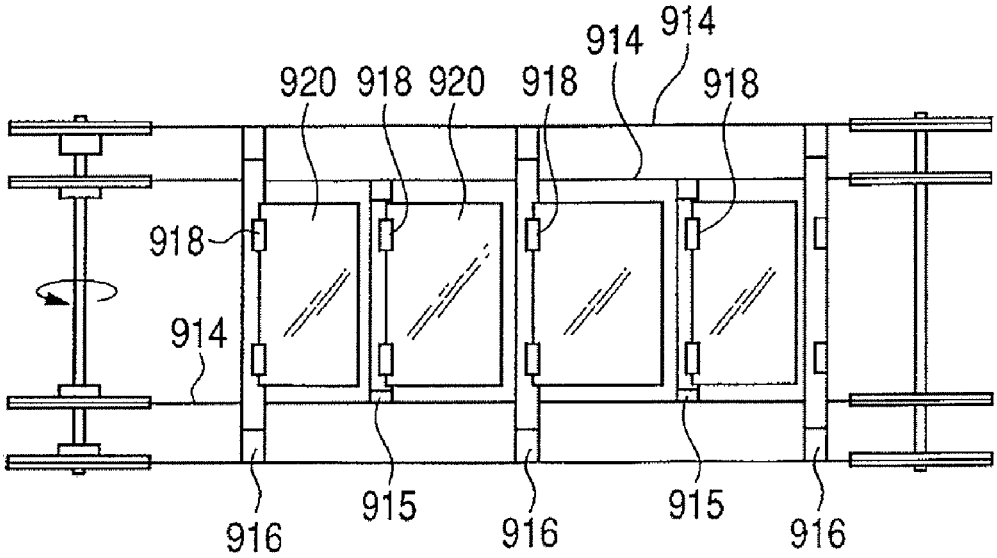

In the case of conveying a large sheet S2, as illustrated in FIG. 7A and FIG. 7B, the second belt 8*d* in the center withdraws to a retracted position with the clutch pulley 18 so that the grippers 7*a* and 7*b* will not hamper large sheet conveyance.

Accordingly, the sequentially conveyed large sheet is sequentially gripped in the tip by the grippers 7*c* and 7*d* on the belts 8*a* and 8*c* on both sides, conveyed onto the stacker tray 16 and stacked.

Here, clutch pulleys can be arranged in the belts on both sides. Then at an occasion of conveying a large sheet, the belts on both sides are stopped so that the sheet can be conveyed only by the belt in the center.

Thus, use of shorter belts can enhance compactness and lightness of the stacker.

The present embodiment was described with an example to cope with two types of sheets different in length but will not be limited thereto. By further providing short belts, three or more sizes can be coped with. Also in that case, at an occasion of conveying a short sheet, the position of the grippers on the further provided belts to the grippers 7*c* and 7*d* in the belt circulating direction can be set in the position corresponding with the size. At an occasion of conveying a long sheet, the grippers are positioned in the retracted positions in advance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-243471, filed Sep. 7, 2006, which is hereby incorporated by reference herein in its entirety.

What is claimed is:

1. A sheet conveying apparatus including:

a first rotary member:

a second rotary member which is provided in parallel to the first rotary member;

a first member provided on the first rotary member, the first member being configured to convey a sheet along a predetermined conveying path while holding the sheet;

a second member provided on the second rotary member, the second member being configured to convey a sheet along the predetermined conveying path while holding the sheet; and controller configured to control the first and second members so as to change an operation between a first state in which the first member and the second member hold and convey the same sheet along the predetermined conveying path and a second state in which the first member and the second member holds and conveys different sheets along the predetermined conveying path respectively according to a length of a sheet along the predetermined conveying path.

2. A sheet conveying apparatus according to claim 1, wherein in a case where a sheet with a first length along the predetermined conveying path is conveyed along the predetermined conveying path, the first member and the second member hold and convey the same sheet, and in a case where a sheet with a second length shorter than the first length is conveyed along the predetermined conveying path, the first member and the second member holds and conveys the different sheets.

3. A sheet conveying apparatus according to claim 2, when the sheets with the second length are conveyed along the predetermined conveying path, a position of said second member relative to a position of the first member in the sheet conveying direction is changed along the predetermined conveying path by a distance according to the length of the sheet.

4. A sheet conveying apparatus according to claim 1, further including:

a release unit configured to releases holding the sheets by said first member and said second member at a releasing position according to the length of the sheet to stack the sheet onto a stacking portion.

5. An image forming apparatus comprising:

an image forming portion forming an image on a sheet; and a sheet conveying apparatus according to claim 1, wherein said sheet conveying apparatus conveys the sheet on which the image is formed by the image forming portion.

* * * * *